US005134919A

United States Patent [19]

Kunimoto

[11] Patent Number: 5,134,919

[45] Date of Patent: Aug. 4, 1992

[54] APPARATUS FOR CONVERTING A WAVEFORM SIGNAL DEPENDENT UPON A HYSTERESIS CONVERSION SIGNAL

[75] Inventor: Toshifumi Kunimoto, Hamamatsu, Japan

[73] Assignee: Yamaha Corporation, Hamamatsu, Japan

[21] Appl. No.: 551,391

[22] Filed: Jul. 12, 1990

[30] Foreign Application Priority Data

Jul. 14, 1989 [JP] Japan ..... 1-183329

[51] Int. Cl.[5] ..... G10H 1/06; G10H 7/00

[52] U.S. Cl. ..... 84/622; 84/659; 307/526; 307/356; 307/359; 328/146; 328/151

[58] Field of Search ..... 84/603-608, 84/615-633, 653-665, 677-711, DIG. 10; 307/525-528, 354-359; 328/146-151

[56] References Cited

U.S. PATENT DOCUMENTS

| | | | |
|---|---|---|---|
| Re. 30,834 | 12/1981 | Niimi et al. | 84/DIG. 10 |
| 4,003,285 | 1/1977 | Schwartz | 84/703 |
| 4,829,872 | 5/1989 | Topic et al. | 84/615 X |
| 4,841,827 | 6/1989 | Uchiyama | 84/DIG. 10 |

FOREIGN PATENT DOCUMENTS 63-40199 2/1988 Japan .

OTHER PUBLICATIONS

"Self-Sustained Oscillations of the Bowed String", R. T. Schumacher, *Acustica*, vol. 43 (1979), pp. 109-120.

*Primary Examiner*—Stanley J. Witkowski
*Attorney, Agent, or Firm*—Graham & James

[57] ABSTRACT

A waveform signal converting apparatus is designed to convert each of instantaneous values of an input waveform signal in accordance with desirable one of plural data conversion functions. Herein, one of plural data conversion functions is selected in response to comparison result of a comparator which compares each of instantaneous values to the reference value. This reference value can be varied in response to the comparison result of comparator and/or a varying tendency of the instantaneous values of the input waveform signal to be increased or decreased. Preferably, there is provided a memory (e.g., ROM) which pre-stores at least one data conversion table for converting the input waveform signal.

5 Claims, 7 Drawing Sheets

5134919

APPARATUS FOR CONVERTING A WAVEFORM SIGNAL DEPENDENT UPON A HYSTERESIS CONVERSION SIGNAL

BACKGROUND OF THE INVENTION

1. Field of the Invention

The present invention relates to a waveform signal converting apparatus which converts a waveform signal representative of a musical tone waveform into a desirable waveform signal.

2. Prior Art

In the conventional waveform signal converting apparatus, the output waveform signal must be univocally determined by the input waveform signal. Because of its simple construction using the converting elements or conversion tables, the input waveform signal is directly converted into the corresponding output waveform signal which is predetermined in advance.

However, in the field of the signal processing, simulation analysis, musical tone synthesis and the like, it is necessary to process the signal non-linearly. In other words, it is necessary to carry out the waveform conversion based on the hysteresis loop.

For example, when converting the waveform signal whose value is to be increased or decreased, the waveform conversion must be carried out such that the conversion locus will be differed between the signal increasing event and signal decreasing event.

Meanwhile, the conventional waveform signal converting apparatus can carry out the simple non-linear waveform conversion. However, the conventional apparatus cannot carry out the waveform conversion such that the hysteresis loop is produced. Hereinafter, such waveform conversion is called "hysteresis waveform conversion".

In addition, there is another problem in that the conventional apparatus capable of carrying out the non-linear waveform conversion must be complicated in its construction.

SUMMARY OF THE INVENTION

It is accordingly a primary object of the present invention to provide a waveform signal converting apparatus capable of carrying out the hysteresis waveform conversion with a simple circuit configuration.

In a first aspect of the present invention, there is provided a waveform signal converting apparatus comprising:

(a) conversion means for converting each of the instantaneous values of an input waveform signal in accordance with one of plural conversion functions;

(b) comparison means for comparing each of the instantaneous values of the input waveform signal to a predetermined reference value, so that one of plural conversion functions is selected in response to a comparison result of the comparison means; and (c) reference value varying means for varying the reference value in response to the comparison result of the comparison means, whereby a converted input waveform signal is obtained from the conversion means.

In a second aspect of the present invention, there is provided a waveform signal converting apparatus comprising:

(a) conversion means for converting each of instantaneous values of an input waveform signal in accordance with one of plural conversion functions;

(b) comparison means for comparing each of instantaneous values of the input waveform signal to a predetermined reference value, so that one of plural conversion functions is selected in response to a comparison result of the comparison means; and (c) reference value varying means for varying the reference value in response to a varying tendency of the instantaneous values of the input waveform signal to be increased or decreased, whereby a converted input waveform signal is obtained from the conversion means.

In a third aspect of the present invention, there is provided a waveform signal converting apparatus comprising:

(a) conversion means for converting each of instantaneous values of an input waveform signal in accordance with one of plural conversion functions;

(b) comparison means for comparing each of instantaneous values of the input waveform signal to a predetermined reference value, so that one of plural conversion functions is selected in response to a comparison result of the comparison means; and (c) reference value varying means for varying the reference value in response to both of the comparison result of the comparison means and a varying tendency of the instantaneous values of the input waveform signal to be increased or decreased, whereby a converted input waveform signal is obtained from the conversion means.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

PREFERRED EMBODIMENTS OF THE PRESENT INVENTION

Figure 1:
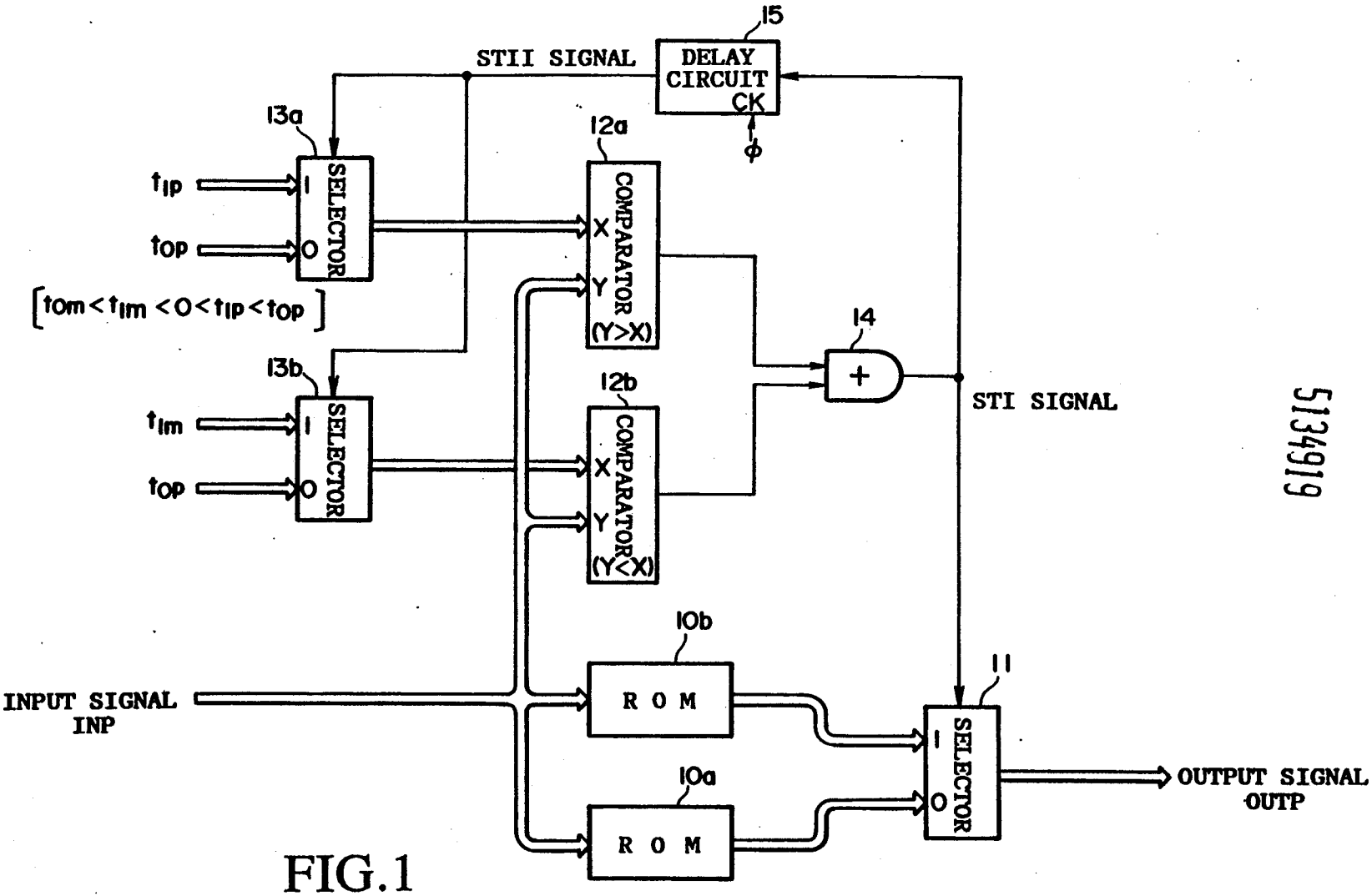
FIG. 1 is a block diagram showing a waveform signal converting apparatus according to a first embodiment of the present invention.

Next, description will be given with respect to the preferred embodiments of the present invention by referring to the drawings, wherein like reference characters designate like or corresponding parts throughout the several views.

[A] FIRST EMBODIMENT

FIG. 1 is a block diagram showing a waveform signal converting apparatus according to a first embodiment of the present invention.

Herein, the waveform signal is inputted into this apparatus as a digital input signal INP representative of instantaneous values contained within the waveform. Then, the converted waveform signal is outputted as a digital output signal OUTP.

In FIG. 1, read-only memories (ROM) 10*a*, 10*b* store respective tables each performing the data conversion. By inputting the input signal INP (hereinafter, referred to as input data) as address data, the corresponding data is read from the corresponding address of the ROM. Therefore, by pre-storing the predetermined conversion data at the predetermined address of each of the ROMs 10*a*, 10*b*, it is possible to carry out the desirable data conversion on the input data. In the present embodiment, the ROM 10*a* pre-stores the conversion pattern as indicated by "FUNCTION I" shown in FIG. 2A, while another ROM 10*b* pre-stores the conversion pattern as indicated by "FUNCTION II" shown in FIG. 2B.

The output data of the ROMs 10*a*, 10*b* are respectively supplied to a selector 11. This selector 11 is designed to select one of two data supplied thereto based on a first state signal (hereinafter, referred to as a STI signal) which will be described later. In the present embodiment, the output of ROM 10*a* is selected when the STI signal is at "0" level, while the output of ROM 10*b* is selected when the STI signal is at "1" level.

The input data (i.e., input signal INP) is not only supplied to the ROMs 10*a*, 10*b* as the address data but also supplied to comparators 12*a*, 12*b*. In addition, outputs of selectors 13*a*, 13*b* are respectively supplied to the comparators 12*a*, 12*b* as reference data. Therefore, the comparators 12*a*, 12*b* compare the input data to their reference data respectively. Each of the comparison results of these comparators 12*a*, 12*b* is indicated by the binary value. Incidentally, the reference data indicates the critical point of conversion data which is used when changing the conversion pattern.

In this case, the comparison result of the comparator 12*a* is at "1" level only while the input data is higher than the reference data. On the other hand, the comparison result of the comparator 12*b* is at "1" level only while the input data is lower than the reference data.

Figure 2A:
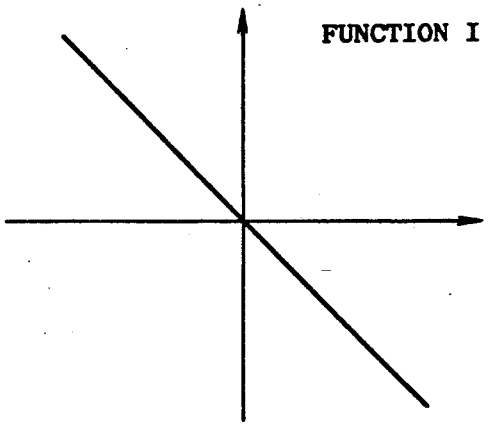
FIGS. 2A to 2C are graphs each showing a data conversion function.
Figure 2B:
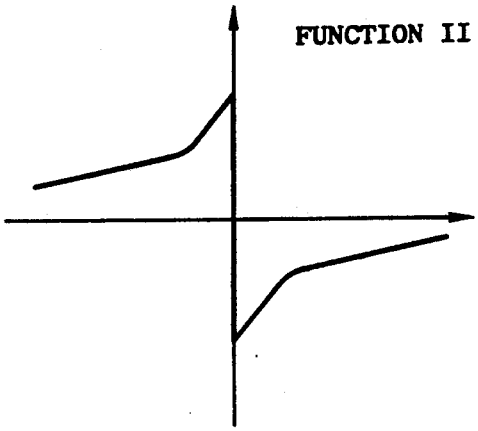
Figure 2C:
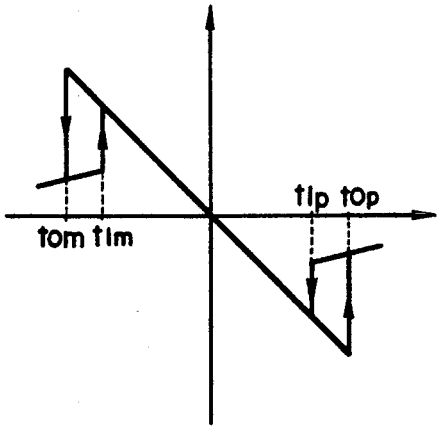

Herein, the selector 13*a* inputs two reference data t1*p*, t0*p*, while another selector 13*b* inputs two reference data t1*m*, t0*m* as shown in FIG. 1. The relationship among these reference data are represented as $t0m < t1m < 0 < t1p < t0p$ as shown in FIG. 2C. In response to a second state signal (hereinafter, referred to as a STII signal) which is delayed behind the foregoing STI signal by one clock, each of the selectors 13*a*, 13*b* selects one of two reference data. When the STII signal is at "1" level, the selectors 13*a*, 13*b* select the reference data t1*p*, t1*m* respectively. On the other hand, when the STII signal is at "0" level, the selectors 13*a*, 13*b* select the reference data t0*p*, t0*m* respectively.

The comparison results of the comparators 12*a*, 12*b* are supplied to an OR circuit 14 wherein they are subject to the OR operation. Then, the output of OR circuit 14 is delivered to both of the selector 11 and a delay circuit 15 as the STI signal. This STI signal is delayed by one clock in the delay circuit 15 so that the STII signal is produced. This STII signal is supplied to both of the selectors 13*a*, 13*b* as described before.

In short, by comparing the input data to the reference data, the comparators 12*a*, 12*b* detect the displacement state of the input data. Based on the detected displacement state of the input data, the comparators 12*a*, 12*b* designate the conversion pattern to be changed and also change the reference data.

Next, description will be given with respect to the operation of the waveform signal converting apparatus according to the present embodiment.

In order to simplify the description of the hysteresis effect of the present embodiment, description will be given with respect to the following two processes:

(i) First process where the input data is gradually increased from "0" to certain value, then, after the input data reaches the certain value, the input data is gradually decreased to "0"; and (ii) Second process where the input data is gradually decreased from "0" to certain value, then, after the input data reaches the certain value, the input data is gradually increased to "0".

(1) First Process

At the initial state where the input data is at "0", the comparison result of comparator 12*a* is at "0" because both of the reference data t0*p*, t1*p* applied to the selector 13*a* have the positive values which are higher than the input data. On the other hand, the comparison result of comparator 12*b* is at "0" because both of the reference data t0*m*, t1*m* applied to the selector 13*b* have the negative values which are lower than the input data. Thus, the OR circuit 14 which inputs both of the comparison results of comparators 12*a*, 12*b* outputs the STI signal at "0" level. Therefore, the selector 11 selects the output of ROM 10*a* so that "FUNCTION I" as shown in FIG. 2A is selected as the conversion pattern.

At next clock timing of the STII signal which is delayed behind the STI signal by one clock, the STII signal is at "0" so that the selectors 13*a*, 13*b* select the reference data t0*p*, t0*m* respectively.

When gradually increasing the input data, the data conversion is carried out in accordance with "FUNCTION I" for a while. However, when the input data exceeds over both of the reference data t1*p*, t0*p*, the comparison result of comparator 12*a* turns from "0" to "1". Such comparison result at "1" level is supplied to one input of the OR circuit 14, and consequently the STI signal outputted from the OR circuit 14 turns to be at "1". Due to this STI signal at "1" level, the selector 11 selects the output of ROM 10*b*. Thus, after the STI signal turns to be at "1" level, the data conversion is carried out in accordance with "FUNCTION II".

When one clock period is passed after the level of STI signal changes from "0" to "1", the level of STII signal changes from "0" to "1" so that the selectors 13*a*, 13*b* select the other reference data t1*p*, t1*m*. Thus, the comparator 12*a* compares the input data to the current reference data t1*p* which is lower than the preceding reference data t0*p*. At this time, the input data is higher than the reference data t1*p*, so that the comparison result of comparator 12*a* remains at "1" level. Such comparison result is not changed even if the input data becomes higher. On the other hand, the comparator 12*b* compares the input data to the reference data having the negative value, so that the comparison result thereof does not turn to be at "1". Thus, even if the input data further increases, the above-mentioned state is not changed.

Next, description will be given with respect to the period when the input data is gradually decreased. Herein, the comparator 12*a* compares the input data to the reference data t1*p* which is lower than t0*p*. Therefore, if the input data decreases lower than the reference data t0*p*, the function of data conversion remains as "FUNCTION II". Thus, the function of data conversion to be employed while the input data is increased between two reference data t1*p*, t0*p* is different from that to be employed while the input data is decreased between two reference data t0*p*, t1*p*. For this reason, the relationship between the input data and output data will not be univocally determined in the present embodiment. When the input data becomes higher than the reference data t1*p*, the comparison result of comparator 12*a* turns from "1" to "0", and consequently the output of OR circuit 14 turns from "1" to "0". As a result, the selector 11 selects the ROM 10*a*, so that the data conversion is carried out based on "FUNCTION I".

After one clock period is passed from the above-mentioned timing, the selected data of the selector 13*a* changes from t1*p* to t0*p* under operation of the STII signal. At this time, the input data becomes lower than the reference data t1*p*, while the reference data is changed to t0*p* which is higher than t1*p*. Thus, the comparison result of comparator 12*a* will not be changed.

Thereafter, the above-mentioned state is not changed until the input data is decreased to "0".

The data conversion in the first process is as shown in fourth quadrant of FIG. 2C.

(2) Second Process

Next, description will be given with respect to the second process wherein the input data is gradually decreased from "0". As similar to the foregoing first process, when the input data is at "0", both of the comparison results of comparators 12*a*, 12*b* are at "0" so that the output of OR circuit 14 is at "0". Thus, the selector 11 selects the output of ROM 10*a* so that the data conversion is carried out in accordance with "FUNCTION I".

While the input data is gradually decreased from "0", the STI signal is set at "0". Therefore, the STII signal which is delayed behind the STI signal by the delay circuit 15 is also set at "0". Then, the selector 13*b* selects the reference data t0*m*, and consequently the comparator 12*b* compares the input data to this reference data t0*m*. When the input data becomes lower than the reference data t0*m*, the comparison result of comparator 12*b* turns from "0" to "1", which consequently turns the output of OR circuit 14 to "1". Thus, the selector 11 selects the ROM 10*b*.

In short, due to the above-mentioned operation, the conversion pattern is changed from "FUNCTION I" to "FUNCTION II". When one clock period is passed after the STI signal is set at "1", the level of the STII signal is changed from "0" to "1" so the reference data selected by the selector 13*b* is changed from t0*m* to t1*m*. In this case, when the input data becomes lower than the reference data t0*m*, the reference data is changed to t1*m* which is higher than t0*m*. Thus, the comparison result of comparator 12*b* remains at "1". Such comparison result is not changed even if the input data is further decreased. Because, the comparison result of another comparator 12*a* which compares the input data having the negative value to the reference data having the positive value is not changed even if the input data is further decreased. In addition, the comparison result of the comparator 12*b* which judges that the input data is lower than the lowest reference data t0*m* is not changed while the input data is further decreased.

Next, description will be given with respect to the case where the input data is gradually increased. In this case, even if the input data becomes higher than the lowest reference data t0*m*, the comparison result of comparator 12*b* is not changed because the selector 13*b* selects the reference data t1*m* which is higher than t0*m*. Therefore, the data conversion is carried out in accordance with "FUNCTION II". In other words, the data conversion function to be used while the input data is decreased from t1*m* to t0*m* is different from the data conversion function to be used while the input data is increased from t0*m* to t1*m*. Thus, as similar to the foregoing first process, the output data of the present apparatus is not univocally determined with respect to the input data.

When the input data becomes lower than the reference data t1*m*, the comparison result of comparator 12*b* turns from "1" to "0". Therefore, the output of OR circuit 14 turns to "0" level, and consequently the selector 11 selects the ROM 10*a*. Thus, the conversion pattern is changed from "FUNCTION II" to "FUNCTION I".

Then, when one clock period is passed after the comparison result of comparator 12*b* turns from "1" to "0", the level of STII signal turns from "1" to "0", so that the reference data selected by the selector 13*b* is changed from t1*m* to t0*m*. In this case, the selected reference data is changed to t0*m* which is lower than t1*m* when the input data becomes lower than t1*m*. Therefore, the comparison result of comparator 12*b* is not changed. Thereafter, such comparison result is not changed until the input data is increased to "0".

The above-mentioned data conversion is as shown in second quadrant of FIG. 2C.

Figure 3:
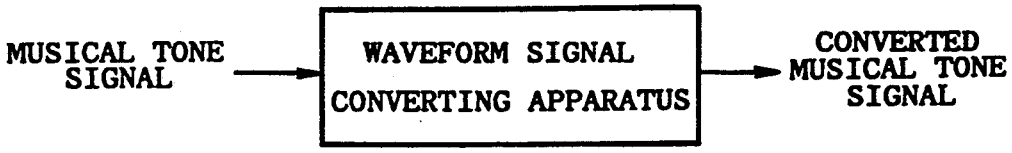
FIG. 3 is a block diagram showing a used example of the first embodiment.
Figure 4A:
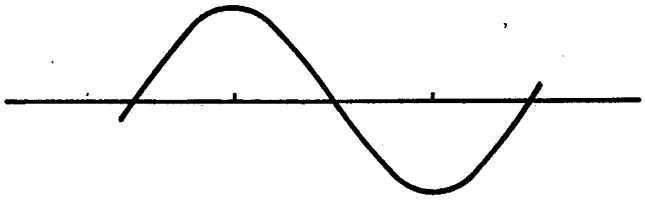
FIGS. 4A, 4B show waveforms indicating the waveform conversion manner of the first embodiment.
Figure 4B:
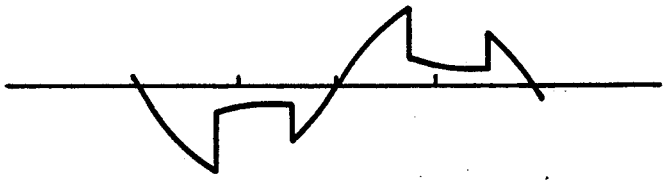

FIG. 3 shows the used example of the waveform signal converting apparatus according to the first embodiment. In FIG. 3 the musical tone signal is applied to the waveform signal converting apparatus wherein the waveform conversion is carried out to apply the hysteresis effect to the musical tone signal. Thus, the input waveform as shown in FIG. 4A is converted into the output waveform as shown in FIG. 4B, for example.

Figure 5A:
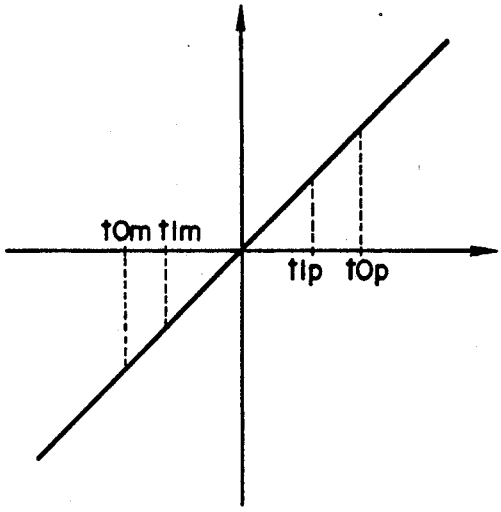
FIGS. 5A, 5B are graphs each showing another example of data conversion function.
Figure 6A:
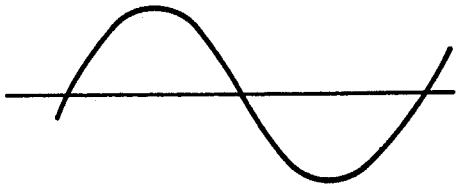
FIGS. 6A, 6B show waveforms indicating the data conversion manner according to the data conversion function as shown in FIGS. 5A, 5B.
Figure 5B:
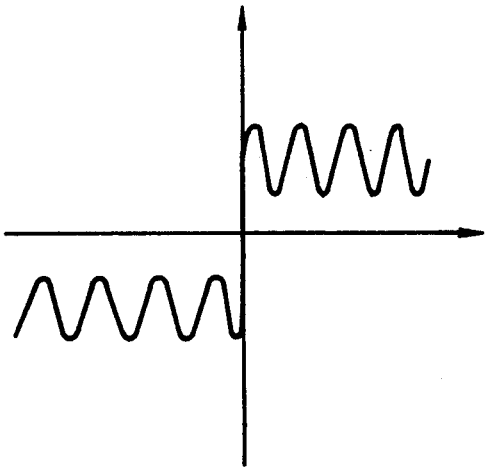
Figure 6B:
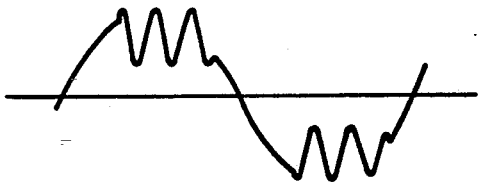

In addition, it is possible to set "FUNCTION I" as shown in FIG. 5A and also set "FUNCTION II" as shown in FIG. 5B. In this case, the input waveform having the sine-curve as shown in FIG. 6A is converted into the output waveform as shown in FIG. 6B, for example.

[B] SECOND EMBODIMENT

Figure 7:
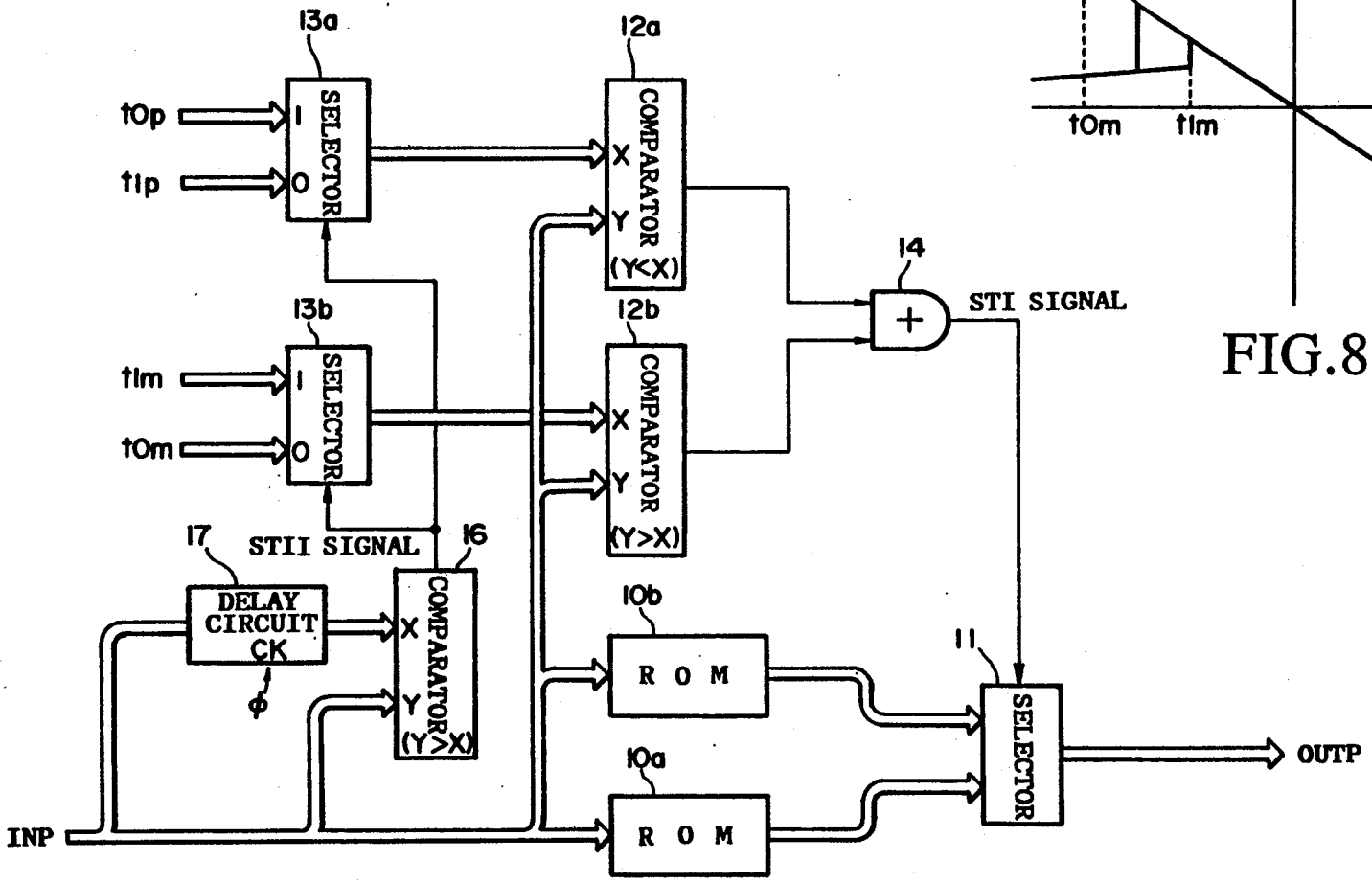
FIG. 7 is a block diagram showing a second embodiment.

FIG. 7 is a block diagram showing a waveform signal converting apparatus according to a second embodiment of the present invention. In order to detect the displacement state of the input data, the second embodiment compares two input data at two adjacent clock timings to each other to thereby judge whether the input data tends to increase or decrease. Such judgement result is used as the STII signal.

In order to detect the displacement state of the input data, the second embodiment provides a comparator 16 and a delay circuit 17. In FIG. 7, the input data is supplied to both of the comparator 16 and delay circuit 17. Herein, the delay circuit 17 delays the input data by one clock so that the delayed input data is supplied to the comparator 16. Therefore, the comparator 16 compares the current input data to the preceding input data which is delayed behind the current input data by one clock. Then, the output of comparator 16 turns to be at "1" level when the current input data is higher than the preceding input data, while the output of comparator 16 turns to be at "0" level when the current input data is not higher than the preceding input data. Such output of comparator 16 is supplied to both of the selectors 13*a*, 13*b* as the STII signal. Based on this STII signal, the reference data to be selected by the selectors 13*a*, 13*b* are determined. The selector 13*b* shown in FIG. 7 functions as similar to the selector 13*b* in the first embodiment shown in FIG. 1. On the other hand, the selector 13*a* shown in FIG. 7 selects the reference data t0*p* when STII is at "1", while the selector 13*a* selects another reference data t1*p* when STII is at "0".

Other circuits of the second embodiment function as similar to those of the first embodiment shown in FIG. 1.

Next, description will be given with respect to the operation of the second embodiment.

At the initial state where the input data is at "0", the second embodiment functions as similar to the foregoing first embodiment.

When the input data starts to increase, the comparator 16 compares the current input data to the preceding input data which is delayed behind the current input data by one clock in the delay circuit 17. Since it is assumed that the input data is increased, the comparison result of comparator is at "1". Thus, the selector 13*a* selects the reference data t0*p*, while another selector 13*b* selects the reference data t1*m*. Therefore, during the period while the input data does not exceed the reference data t0*p*, both of the comparison results of comparators 12*a*, 12*b* turn to be at "0" level. Thus, the STI signal to be outputted from the OR circuit 14 and then supplied to the selector 11 is at "0" level. Due to the STI signal at "0" level, the selector 11 selects the output of ROM 10*a* so that the data conversion is carried out in accordance with "FUNCTION I". Then, when the input data becomes higher than the reference data t0*p*, the comparison result of comparator 12*a* turns from "0" to "1", by which the STI signal outputted from the OR circuit 14 is turned to be at "1" level. Thus, the selector 11 selects the ROM 10*b*. Thereafter, the data conversion will be carried out in accordance with "FUNCTION II".

In the foregoing first embodiment, when one clock is passed after the data conversion function is changed as described above, the level of the STII signal is changed from "0" to "1" so that the reference data to be selected by the selectors 13*a*, 13*b* are changed. In contrast, the comparison result of comparator 16 in the second embodiment is not changed so that the reference data to be selected by the selectors 13*a*, 13*b* are not changed as long as the input data is increased.

However, when the input data starts to decrease, the comparison result of comparator 16 is changed from "1" to "0". Thus, the selector 13*a* selects the reference data t1*p*, while another selector 13*b* selects the reference data t0*m*. Therefore, when the input data is gradually decreased not to be higher than the reference data t1*p*, the comparison result of comparator 12*a* is turned from "1" to "0". Thus, under operation of the STI signal outputted from the OR circuit 14, the selector 11 selects the output of ROM 10*a*. As a result, the second embodiment carries out the data conversion as similar to that of the first embodiment. This data conversion is as shown by fourth quadrant of FIG. 2C.

As described above, while the input data increases from "0", exceeds over the reference data t0*p* and then gradually decreases, the second embodiment operates as similar to the first embodiment. However, while the input data exceeds over the reference data t1*p* and then decreases before reaching the reference data t0*p*, the second embodiment carries out the following data conversion which is different from that of the first embodiment.

Just before the input data starts to decrease, the selector 11 selects the ROM 10*a* so that the data conversion is carried out in accordance with "FUNCTION I". However, when the input data starts to decrease, the comparison result of comparator 16 is changed from "1" to "0" so that the selector 13*a* selects the reference data t1*p*. Since the input data is higher than this reference data t1*p*, the comparison result of comparator 12*a* is changed from "0" to "1". Consequently, under operation of the STI signal outputted from the OR circuit 14, the selector 11 selects the output of ROM 10*b*. Thereafter, the second embodiment starts to carry out the data conversion in accordance with "FUNCTION II".

In the case where the input data is further decreased to be lower than the reference data t1*p*, the second embodiment carries out the data conversion in accordance with "FUNCTION I".

Figure 8:
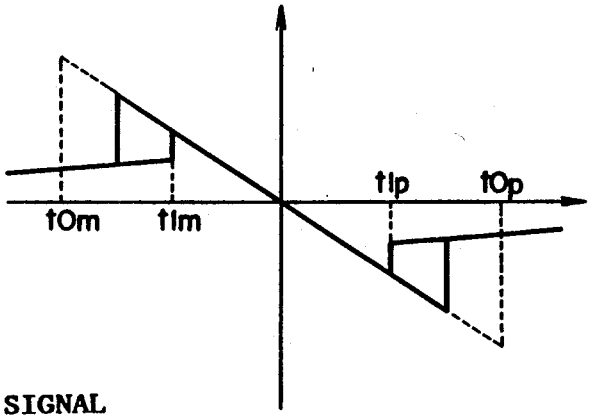
FIG. 8 is a graph showing the data conversion function of the second embodiment.

The above-mentioned process is shown by the solid line in fourth quadrant of FIG. 8.

In the case where the input data is lower than "0" and still decreased, the selector 13*b* selects the reference data t0*m*. On the other hand, in the case where the input data is lower than "0" but increased, the selector 13*b* selects the reference data t1*m*. In such case where the input data is lower than "0", the process of data conversion is set as similar to that in the case where the input data is higher than "0". This process is shown in second quadrants of FIG. 2C and FIG. 8.

[C] THIRD EMBODIMENT

Figure 9:
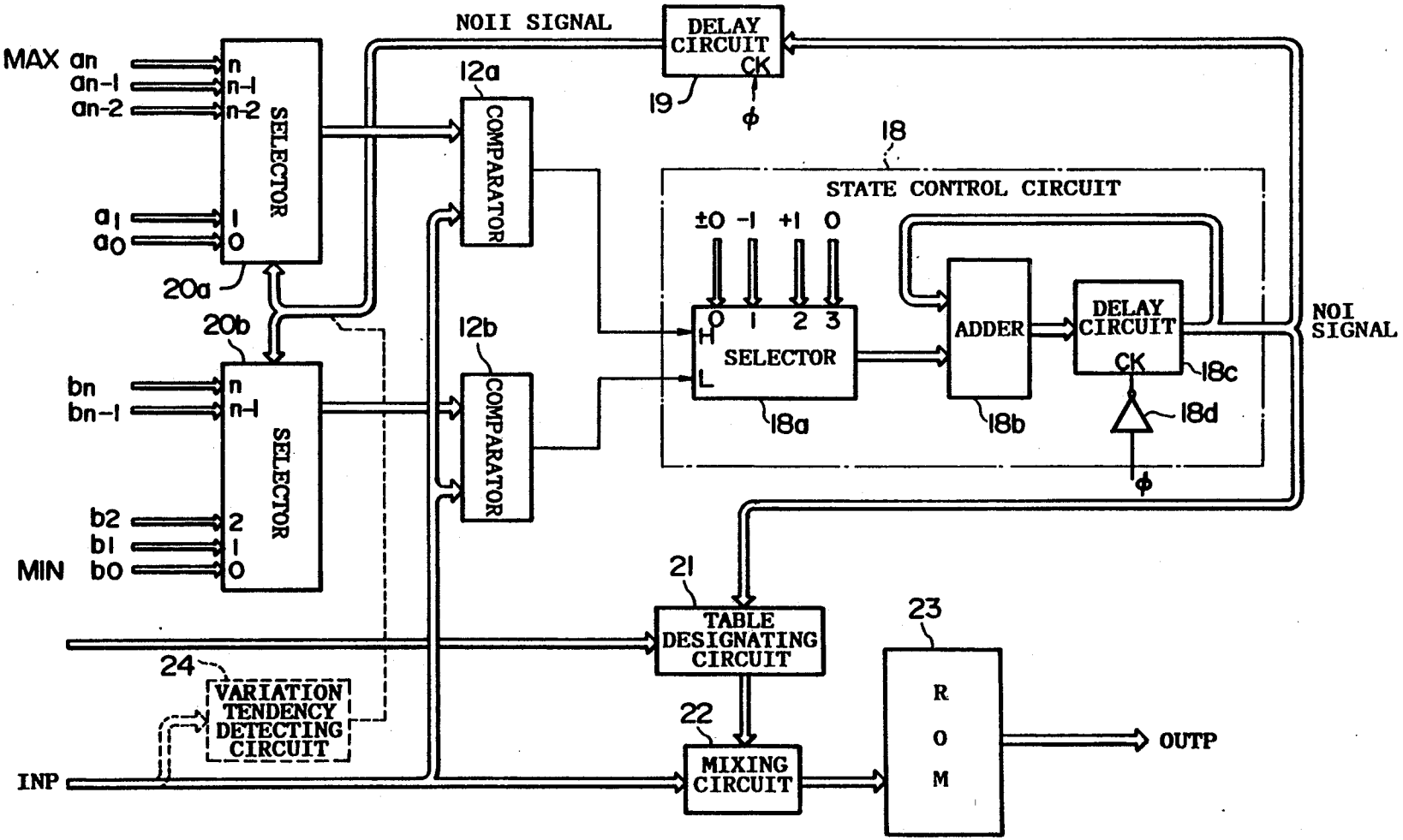
FIG. 9 is a block diagram showing a third embodiment.

FIG. 9 is a block diagram showing a waveform signal converting apparatus according to a third embodiment of the present invention.

As similar to the foregoing embodiments, the comparators 12*a*, 12*b* of the third embodiment compares the input data to the respective reference data. Then, the comparison results of comparators 12*a*, 12*b* are supplied to a state control circuit 18 as a 2-bit control signal consisting of a high-bit (H-bit) and a low-bit (L-bit). More specifically, the comparison result of comparator 12*a* is used as the H-bit, while the comparison result of comparator 12*b* is used as the L-bit.

Such 2-bit control signal having one of the decimal values "0", "1", "2", "3" is used as a select signal of a selector 18*a*. In response to the decimal value of such select signal, the selector 18*a* selects one of four input values.

Herein, the following table shows the relationship between the select signal and H-bit, L-bit.

TABLE

| H | L | Select signal |
|---|---|---|
| 0 | 0 | 0 |
| 0 | 1 | 1 |
| 1 | 0 | 2 |
| 1 | 1 | 3 |

Incidentally, the case where both of H-bit and L-bit are at "1" is not occurred in theory. Thus, such case must be the error.

In addition, the four input values of selector 18a "±0", "−1", "+1", "0" are represented by respective digital data of plural bits corresponding to the decimal values "0", "1", "2", "3" of the select signal. Such digital data corresponds to accumulated data of a first state-number signal (hereinafter, simply referred to as NOI signal) which will be described later.

The accumulated data outputted from the selector 18a is supplied to an adder 18b. The output of adder 18b is delayed by one clock in a delay circuit 18c so that the delayed output of delay circuit 18c is outputted as the NOI signal. Therefore, the adder 18b adds the accumulated data to the NOI signal, and then the addition result thereof is supplied to the delay circuit 18c. Herein, a clock signal $\phi$ is supplied to the delay circuit 18c via an inverter 18d. Under operation of the inverted clock signal, the delay circuit 18c can input the addition result of adder 18b certainly.

The NOI signal outputted from the delay circuit 18c is delayed by one clock in a delay circuit 19, and then the delayed NOI signal is outputted as a second state-number signal (hereinafter, simply referred to as NOII signal). This NOII signal is supplied to both of selectors 20a, 20b.

Figure 10:
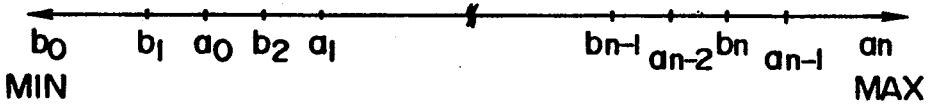
FIG. 10 indicates the relationship between plural reference data to be used in the third embodiment.

Each of the selectors 20a, 20b inputs (n+1) reference data which are as shown in FIG. 10. Herein, the selector 20a inputs reference data $a_0, a_1, \ldots, a_n$, while another selector 20b inputs reference data $b_0, b_1, \ldots, b_n$. As shown in FIG. 10, $a_n$ is the maximum and $b_0$ is the minimum within the reference data. In response to the NOII signal which is used as the select signal, one of (n+1) reference data is selected by each of the selectors 20a, 20b. In the present embodiment, the value of NOII signal varies from "0" to "n". Therefore, in response to the value of NOII signal, the selector 20a selects corresponding one of the reference data $a_0$ to $a_n$ and another selector 20b selects corresponding one of the reference data $b_0$ to $b_n$. Incidentally, both of the maximum reference data $a_n$ and minimum reference data $b_0$ are set within the range of the input data.

The NOI signal outputted from the state control circuit 18 is supplied to a table designating circuit 21 wherein a table selecting information signal is added to the NOI signal. This table selecting information signal is used when changing over the data conversion function or critical point. Therefore, if such change is not required, the table designating circuit 21 can be omitted. Then, the output of table designating circuit 21 is supplied to a mixing circuit 22 wherein the output of table designating circuit 21 is mixed into the input data as its upper bits (e.g., leftmost nybble). Thus, by passing through the mixing circuit 22, the the input data is converted into the mixed input data of which upper bits represent the table selecting information and function information corresponding to the NOI signal. Next, a ROM 23 provides plural function tables each of which is selected by the table selecting information. Hence, the predetermined data conversion is carried out in accordance with the function corresponding to the NOI signal within the selected function table of the ROM 23. Incidentally, the ROM 23 also provides (n+1) functions consisting of "FUNCTION 0" to "FUNCTION n" corresponding to the NOI signal whose value ranges from "0" to "n". Herein, (n+1) functions can be different from each other, or (n+1) functions can include a number of the same functions.

Next, description will be given with respect to the operation of the third embodiment. Herein, the input data is set at the value which is lower than the reference data $a_0$ but higher than the reference data $b_0$. At the initial state, the NOI signal is at "0" so that the NOII signal to be outputted from the delay circuit 19 and then supplied to the selectors 20a, 20b is at "0". Due to this NOII signal at "0" level, the selectors 20a, 20b select the reference data $a_0$, $b_0$ respectively.

As described before, the NOI signal representative of the function information is added to the input data as its upper bits in the mixing circuit 22. Thus, the ROM 23 carries out the data conversion in accordance with "FUNCTION 0".

The comparator 12a compares the input data to the reference data $a_0$. At this time, the input data is set lower than the reference data $a_0$. Therefore, the H-bit is set at "0" in the state control circuit 18. On the other hand, the comparator 12b compares the input data to the minimum reference data $b_0$. In this case, there is no possibility in that the input data becomes lower than the reference data $b_0$. Therefore, the L-bit is set at "0" in the state control circuit 18.

Based on the select signal "0" which is represented by the above-mentioned H-bit and L-bit, the selector 18a selectively outputs the value "±0" to the adder 18b. Thus, the current NOI signal remains as it is.

Even if the input data is gradually increased, the data conversion is carried out in accordance with the same "FUNCTION 0" until the input data exceeds over the reference data $a_0$.

When the input data exceeds over the reference data $a_0$, the comparison result of comparator 12a turns to "1" so that the H-bit in the state control circuit 18 turns to "1". Even if the H-bit turns to "1", the comparison result of comparator 12b is not changed so that the L-bit remains at "0". As a result, the select signal of the selector 18a has the value "2" so that the selector 18a selectively outputs the value "+1" to the adder 18b. Under operation of the adder 18b and delay circuit 18c, the NOI signal turns to be at "1" level when one clock is passed after the select signal turns to "2". As described before, the NOI signal passes through the table designating circuit 21 and mixing circuit 22 to thereby designate the data conversion function. From this time one, the data conversion is carried out in accordance with "FUNCTION 1".

Meanwhile, by passing through the delay circuit 19, the NOI signal is converted into the NOII signal, by which the selectors 20a, 20b select the reference data $a_1$, $b_1$ respectively.

In this case, the input data can be higher than the reference data $a_1$. However, in general, the input data is higher than $a_0$ but lower than $a_1$. Thus, the comparison result of comparator 12a turns to be at "0" level.

It is apparent from FIG. 10, the input data is not lower than the reference data $b_1$ because it is higher than the reference data $a_0$. Thus, the comparison result of comparator 12b is at "0" level.

In short, both of the comparison results of comparators 12a, 12b are set at "0" level. Therefore, both of the H-bit and L-bit are at "0" level so that the select signal is at "0" level. Based on this select signal at "0" level, the selector 18a selects the value "±0". Consequently, the value of the NOI signal is maintained at the current value "1".

Thereafter, as the input data increases, both of the NOI signal and NOII signal gradually increase. Thus, both of the data conversion function and reference data corresponding to the critical point are to be varied.

When the value of NOI signal is incremented to "n", the selector 20a selects the reference data $a_n$. Since this reference data $a_n$ has the maximum value within the range of the input data, there is no possibility in that the input data exceeds the reference data $a_n$. For this reason, the comparison result of comparator 12a cannot be set at "1", and consequently the selector 18a cannot selectively output the value "+1". Thus, there is no possibility that the NOI signal would be increased over the value "n".

Next, description will be given with respect to the operation of the third embodiment in the case where the input data is decreased. In order to clearly describe this operation, the input data exceeds over the reference data $a_0$ so that the NOI signal turns to "1", and then the input data starts to be decreased.

In this case, the reference data $a_1$, $b_1$ are respectively supplied to the comparators 12a, 12b. Therefore, even if the input data varies between these reference data $a_1$, $b_1$, the comparison results of comparators 12a, 12b are not changed. Therefore, if the input data is decreased lower than $a_0$ but still higher than $b_1$, the data conversion function is not changed. In the present embodiment, the data conversion function is differed between the increasing event and decreasing event of the input data, so that the hysteresis effect can be achieved.

When the input data becomes lower than the reference data $b_1$, the comparison result of comparator 12b turns to "1". Hence, the H-bit is set at "0", while the L-bit is set at "1" in the state control circuit 18. Consequently, the select signal to be supplied to the selector 18a turns to "1" so that the value "−1" is selectively outputted from the selector 18a. This value "−1" is added to the current NOI signal in the adder 18b. Then, the addition result of adder 18b is supplied to the delay circuit 18c. Due to the above-mentioned addition, the value of NOI signal which is at "1" precedingly is decremented to "0". As a result, the delay circuit 19 outputs the new NOII signal at "0" level to the selectors 20a, 20b. Thus, the selectors 20a, 20b select the reference data $a_0$, $b_0$ again. In addition, the new NOI signal at "0" level is supplied to the ROM 23 via the table designating circuit 21 and mixing circuit 22, so that the data conversion is carried out in accordance with "FUNCTION 0".

When the NOI signal turns to be at "0" level, the selector 20b selects the reference data $b_0$ which is the minimum within the range of the input data. As described before, the input data cannot be lower than this reference data $b_0$. Therefore, the comparison result of comparator 12b cannot turn to "1". Thus, the selector 18a cannot selectively output the value "−1". Consequently, there is no possibility in that the NOI signal is decreased lower than "0".

As described heretofore, as the input data increases or decreases, the data conversion function is changed. As a result, the hysteresis is produced with respect to the critical point at which the data conversion function is changed.

At the initial state, the NOI signal is at "0". However, in some cases, the input data is quite higher than the reference data $a_0$. In such case, the comparison result of comparator 12a remains at "1" for several clock periods after the initial state so that the NOI signal is increased to the predetermined value. Thereafter, the above-mentioned process will be performed.

Figure 12:
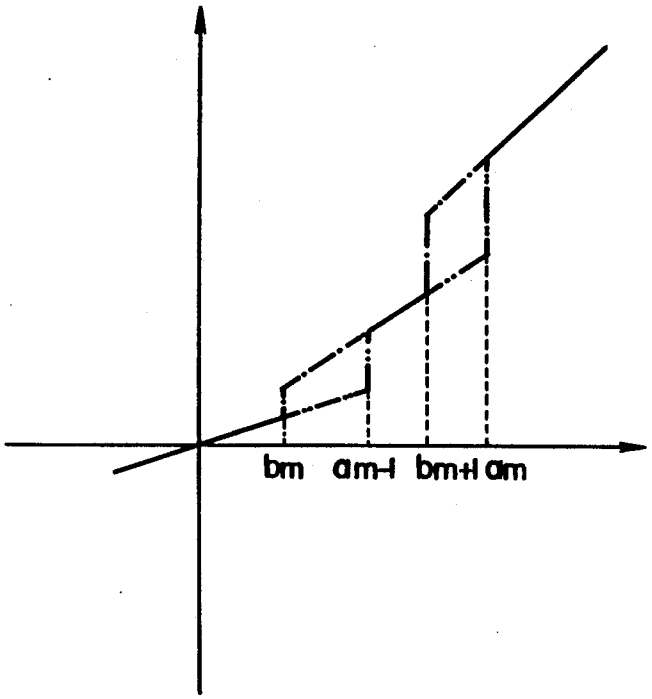
FIG. 12 is a graph showing the data conversion manner of the third embodiment.
Figure 11:
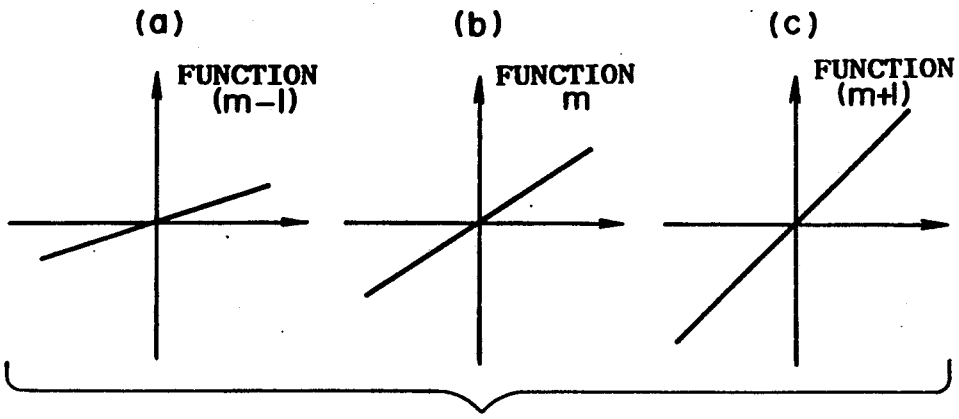
FIG. 11 shows graphs each showing the data conversion function to be used in the third embodiment.

FIG. 11 shows three graphs each representing an example of the data conversion function to be stored in the ROM 23. FIG. 12 shows the process wherein the data conversion is carried out on the input data in accordance with the data conversion functions as shown in FIG. 11.

In FIG. 12, solid line indicates the common locus along which the input data is increased or decreased; two-dot chain line indicates the locus along which the input data is increased; and dashed line indicates the locus along which the input data is decreased.

Meanwhile, as shown by the dotted line in FIG. 9, the third embodiment can be modified to further provide a variation tendency detecting circuit 24 which detects whether the input data is in the increasing tendency or decreasing tendency. The detection result of this variation tendency detecting circuit 24 is used as the least significant bit (LSB) of the NOII signal. This variation tendency detecting circuit 24 can be constructed by a comparator and a one-clock delay circuit (not shown). These comparator and one-clock delay circuit construct the feedback loop such that the input data is directly supplied to first input of the comparator and the output of comparator is fed back to its second input via the one-clock delay circuit. Hence, the comparator compares the current input data to the preceding input data which is delayed behind the current input data by one clock. The comparison result of this comparator is at "1" only while the current input data is higher than the preceding input data. In contrast, the comparison result is at "0" while the current input data is not higher than the preceding input data.

In the above-mentioned modification of the third embodiment, both of the NOI signal and NOII signal are incremented by "1" when the input data is increased. When the input data is decreased, the NOI signal and NOII signal have the values which are as described before in the third embodiment. Hence, this modification can carry out the complicated waveform conversion as comparing to the third embodiment.

In order to provide the data conversion function, it is possible to employ the method other than the function table set in the ROM. For example, the data conversion function can be embodied by executing the computation or by use of the conversion element and the like.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A waveform signal converting apparatus comprising:

(a) conversion means, having at least two different conversion functions, each of said conversion functions defining different input versus output characteristics over a range of input values, said conversion means operative for converting successive values of an input waveform signal in accordance with one of said conversion functions;

(b) comparison means for comparing each of said successive values of said input waveform signal to a predetermined reference value, and for selecting which of said conversion functions is to be selected to convert said successive values in response to said comparison result of said comparison means; and (c) reference value varying means for varying the reference value in response to the comparison result of said comparison means, whereby a conversion following a hysteresis profile is imparted upon said input waveform signal to produce an output waveform signal.

2. A waveform signal converting apparatus comprising:

(a) conversion means, having at least two different conversion means, each of said conversion functions defining different input versus output characteristics over a range of input values, said conversion means operative for converting successive values of an input waveform signal in accordance with one of said plural conversion functions;

(b) comparison means for comparing each of said successive values of said input waveform signal to a predetermined reference value, and for selecting which of said conversion functions is to be selected to convert said successive values in response to said comparison result of said comparison means; and (c) reference value varying means for varying the reference value in response to a varying tendency of the input signal successive values to be increased or decreased, whereby a conversion following a hysteresis profile is imparted upon said input waveform signal to produce an output waveform signal.

3. A waveform signal converting apparatus comprising:

(a) conversion means, having at least two different conversion functions, each of said conversion functions defining different input versus output characteristics over a range of input values, said conversion means each being unique within at least a determinable range, said conversion functions operative for converting successive values of an input waveform signal in accordance with one of plural conversion functions;

(b) comparison means for comparing each of said successive values of said input waveform signal to a predetermined reference value, and for selecting which of said conversion functions is to be selected to convert said successive values in response to said comparison result of said comparison means; and (c) reference value varying means for varying the reference value in response to both of the comparison result of said comparison means and a varying tendency of the input signal successive values to be increased or decreased, whereby a conversion following a hysteresis profile is imparted upon said input waveform signal to produce an output waveform signal.

4. A waveform signal converting apparatus according to any one of claims 1, 2, 3 wherein said conversion means is constructed by a memory which pre-stores at least one data conversion table.

5. A waveform signal converting apparatus according to any one of claims 1, 2, 3 wherein said input waveform signal is a musical tone signal.

* * * * *